US005725631A

United States Patent [19]

Dorofeev et al.

[11] Patent Number: 5,725,631

[45] Date of Patent: Mar. 10, 1998

[54] COMPOSITE CHARGE FOR METALLURGICAL PROCESSING

[75] Inventors: Genrikh Alekseevich Dorofeev, Tula; Serafim Zakharovich Afonin, Moscow; Aleksandr Vladimirovich Makurov; Anatolii Georgievich Sitnov, both of Tula, all of Russian Federation

[73] Assignee: Intermet-Service & Company, Tula, Russian Federation

[21] Appl. No.: 588,382

[22] Filed: Jan. 18, 1996

[30] Foreign Application Priority Data

Feb. 13, 1995 [RU] Russian Federation ..... 95-102222

[51] Int. Cl.[6] ..... C22B 1/248

[52] U.S. Cl. ..... 75/312; 75/316; 75/317; 75/751

[58] Field of Search ..... 75/312, 316, 317, 75/751

[56] References Cited

U.S. PATENT DOCUMENTS

| | | | |
|---|---|---|---|
| 2,710,796 | 6/1955 | Pinkerton | 75/25 |
| 3,948,612 | 4/1976 | Schulten-Baumer | 29/187.5 |
| 4,564,388 | 1/1986 | Vallomy | 75/12 |
| 4,581,068 | 4/1986 | Schramm | 75/312 |
| 4,797,154 | 1/1989 | Benedetti et al. | 75/46 |
| 4,957,546 | 9/1990 | Lazcano-Navarro | 75/529 |
| 5,364,441 | 11/1994 | Worner | 75/10.1 |
| 5,425,797 | 6/1995 | Dorofeev et al. | 75/306 |
| 5,562,753 | 10/1996 | de Lassat de Presigny et al. | 75/10.63 |

*Primary Examiner*—Melvyn Andrews

*Attorney, Agent, or Firm*—Heller Ehrman White & McAuliffe

[57] ABSTRACT

A composite charge for metallurgical processing which reduces the content of non-metallic inclusions in the end product(s) comprises 40–83 wt. % of a metallic agent, 17–50 wt. % of an oxide agent and 0.1–10.0 wt. % of a carbonaceous agent. The carbonaceous agent includes a mixture of metal carbides and free carbon, preferably graphite, having a ratio in the range of 0.1–10.0:1.

13 Claims, No Drawings

COMPOSITE CHARGE FOR METALLURGICAL PROCESSING

FIELD OF THE INVENTION

The present invention relates in general to ferrous metallurgy, and more particularly to a composite charge used for the production of steel and alloys.

BACKGROUND OF THE INVENTION

It is known that a composite charge can be produced from alloyed steel scrap and/or alloy scrap. The charge generally includes a metallic agent, an oxidizing agent and a reducing agent. In order to reduce the loss of alloying elements (due to melting), increase the yield of the end product, and lower the production costs, such a charge generally contains shavings of alloyed steel or alloy as the metallic agent, scale of a basic alloy and/or a mixture of oxides as the oxidizing agent, and screenings of aluminum shavings and/or aluminum "middlings" (i.e., products of medium quality, grade and/or size) as the reducing agent.

The composite charge generally contains: 15–50 wt. % shavings of alloyed steel or alloy; 35–55 wt. % scale of basic alloy and/or a mixture of oxides; and 17–30 wt. % screenings of aluminum shavings and/or aluminum middlings.

A major drawback of this charge material is the relatively low yield of usable product. This is due, in significant part, to the inherent difficulties associated with mixing charge components that differ significantly in physical and chemical properties, especially density. Other factors which contribute to the low yield include the inherent problems associated with conventional mechanical mixing methods (e.g., equipment performance, mix indices) and the large difference in the granulometric, physical and chemical properties of the constituent components, which may not allow the production of a well developed surface on the reactants, especially under conditions where the charge has a relatively large mass. Surface irregularities on the reactance adversely effect the process kinetics, slow the reduction of oxides, lower the percent extraction of elements from the oxides and increase consumption of the reducing agent to levels commensurate with the amount of metal additive in the charge.

Further, because it is virtually impossible to use a charge of known composition during melting of steel (with oxidation), the applicability of such a charge material is limited to re-melting processes and to the production of steels of one brand assortment.

Additional problems associated with the conventional charge material include (i) aluminum in the form of screenings of aluminum shavings and/or aluminum middlings is a costly component and in very short supply, and (ii) dispersion of non-metallic inclusions of oxides and aluminum nitrides tend to contaminate and, hence, adversely effect the quality of the end product.

Finally, the elevated reducing agent content in the charge and its high consumption further increases the costs associated with this charge material and lowers the technical and economic indices of its use.

It is therefore an object of the present invention to provide a composite charge for metallurgical processing which increases the yield of usable product.

It is another object of the invention to provide a composite charge for metallurgical processing that lowers the production costs of the charge material and the products made therefrom.

It is yet another object of the invention to provide a composite charge for metallurgical processing which reduces the content of non-metallic inclusions in the products made therefrom.

SUMMARY OF THE INVENTION

The composite charge of this invention comprises 40–83 wt. % of a metallic agent, 17–50 wt. % of an oxide agent and 0.1–10 wt. % of a carbonaceous agent. The metallic agent preferably includes a carbide-forming component comprising a material selected from the group consisting of iron, chromium, manganese, boron, calcium, vanadium, tungsten and mixtures thereof. The carbonaceous agent comprises a mixture of metal carbides and free carbon, preferably graphite, having a ratio in the range of 0.1–10.0:1. The oxide agent may comprise oxidized flux bearing and flux free iron-ore materials, i.e. , agglomerate or pellets of raw ore and their waste products, scale, oxidized metal scrap, fragmentized metal waste, and solid oxidizers obtained by agglomeration of the dust and sludge from metallurgical processes.

DESCRIPTION OF PREFERRED EMBODIMENTS

The composite charge material of the present invention substantially reduces or eliminates the disadvantages and shortcomings associated with prior art charge materials. According to the invention, the composite charge material comprises 40–83 wt. % of a metallic agent, 17–50 wt. % of an oxide agent and 0.1–10 wt. % of a carbonaceous agent. In a preferred embodiment of the invention, the composite charge comprises 40–82.8 wt. % of a metallic agent, 17.1–50 wt. % of an oxide agent and 0.1–10 wt. % of a carbonaceous agent.

According to the invention, the metallic agent (i.e., metal containing material) includes a carbide forming component comprising a material selected from the group consisting of iron, chromium, manganese, boron, calcium, vanadium, tungsten and mixtures thereof. Thus, conventional iron-carbon alloys, such as basic pig iron, may be employed as the metallic agent.

The oxide agent (i.e., oxide containing material) may comprise oxidized flux bearing and flux free iron-ore materials, i.e. , agglomerate or pellets of raw ores and their waste products, scale, oxidized metal scrap, fragmentized metal waste and solid oxidizers obtained by agglomeration of flue dust and sludge from metallurgical processes. The composition of various exemplary oxide agents is set forth in co-pending application Ser. No. 08/567,550, Filed Dec. 5, 1995, incorporated by reference herein.

In a preferred embodiment of the invention, the oxide agent comprises 5–50 wt. % of a slag forming component. As will be recognized by one having ordinary skill in the art, the slag forming components may include lime stones, sinter, fire clay and the like.

A key characteristic of the invention is that the charge material includes a carbonaceous agent (i.e., carbon containing material) as a reducing agent. According to the invention, the carbonaceous agent comprises a mixture of metal carbides and free carbon, preferably in the form of graphite. In a preferred embodiment, the metal carbides and free carbon have a ratio in the range of 0.1–10.0:1.

According to the invention, the production of the composite charge is accomplished by virtue of the fact that the charge comprises a mixture of components in monolithic pieces that are capable of predominantly endothermic reactions. As the charge is heated, the oxides contained in the charge are reduced by the carbonaceous (reducing) agent. As a result, the oxides are thus reduced to the metallic state, the gaseous reaction products are driven into the slag, and the excess carbon is oxidized by the oxide agent.

The energy produced as a result of exothermic reactions occurring between the oxygen of the oxidizing agent and the elements of the reducing agent that are present in the metallic agent (having, a higher affinity for oxygen than carbon, e.g., Si, Mn) is an additional source of heat.

As stated above, according to the invention, the source for supply of the reducing agent (in the form of carbon) is the carbonaceous agent. An additional source is the carbon dissolved in the metallic agent in the form of metal carbides and/or free carbon.

The oxides in the oxide agent and, in part, in the slag-forming components are the source of oxygen (the oxygen carrier). According to the invention, as the charge is heated and melted, oxygen is exchanged between the oxide agent and the reducing agent. As a result, the carbon is oxidized to carbon monoxide, the latter being evolved in the form of a gaseous phase that agitates the melt, and the metal oxides, giving up oxygen, are reduced to the metallic state. The composition of the charge can thus be tailored to ensure the highest possible reduction of the oxides and the production of steel and/or alloy having the requisite concentration of carbon.

Significant improvements in the technical and economic indices are realized by tailoring the composition of the charge and employing it in "lumped" form, where the charge components (or elements) exhibit a highly developed phase contact surface. According to the invention, the phase contact surface is formed and/or developed by pouring the metallic agent onto the melt during processing, the amount of which being held constant during loading of the charge into the furnace, heating, and calcination. This improves the kinetics of the oxidation-reduction reaction(s), and increases the process rate and percent extraction of elements from the metal oxides (the yield of usable product).

Applicants have found that where an iron-carbon melt is the metallic agent and iron oxides are the oxide agent, the proposed charge has a carbon oxidation rate in the range of 0.4–0.8% C/min, i.e., at the level of the oxygen-converter process. Here, the redox reaction proceeds at a reduced temperature, beginning at 800–850° C., and has a high rate. For this reason, nearly complete reduction of the oxides and maximum removal of carbon are attained.

Replacing the aluminum, which in the prior art material simultaneously acts as reducing agent and heat source, with an inexpensive reducing agent, such as carbon, and supplying heat to compensate for the energy consumption resulting from the endothermic reactions of the reduction of the oxides by carbon, makes it possible to sharply reduce the cost of the charge and, hence, the end product. As will be recognized by one having ordinary skill in the art, the cost per unit heat in the form of electric power is always lower than the cost of heat released by the oxidation of aluminum.

Further, the quality of the end product (metal) is improved since the gaseous reaction products resulting from the oxidation of carbon by the oxygen (i) agitate the melt of the composite charge and the entire metal bath, driving the gases out of the melt, (ii) promote the migration of nonmetallic inclusions to the slag, and (iii) prevent the gases from the furnace atmosphere from penetrating into the metal bath.

The agitation of the metal bath by the carbon monoxide bubbles also intensifies the heat transfer therein, facilitating a lower energy consumption. Further, the presence of carbon monoxide in the working volume of the furnace and in the charge layer lowers the free oxygen content in the furnace atmosphere and the percent oxidation of the solid charge and liquid metal. As a result, there is an additional increase in metal extraction and in the yield of usable product.

After the charge melts, the metal comprises an alloy of elements reduced from the oxides and metallic agents fused by heat from the external source. The composition of the slag remains practically unchanged since gaseous oxides of carbon and not liquid oxides are the reaction product. A small fraction of the oxide component does however migrate to the slag. This makes it possible to adjust the quantitative composition of the slag phase according to process requirements, particularly by pre-injecting the slag-forming components into the starting composite charge or, as melt-down of the charge proceeds, directly into the furnace.

The use of elements of the metallic agent, such as carbonaceous silicon (introduced as metallic Si or SiC) and/or a mixture of metal carbides makes it possible to increase the utilization of the carbon and to significantly increase the stability of the carbonization process. This is due to the fact that silicon, which under the noted conditions has a higher affinity for oxygen than carbon, oxidizes first.

The introduction of slag-forming agents, such as lime, enhances the thermodynamic process of silicon oxidation, since the $SiO_2$ formed is bound in thermodynamically stable calcium silicates. Consequently, by readily oxidizing, the silicon inhibits carbon oxidation, promoting a more complete and stable uptake of the carbon by the metal bath.

The composite charge of the invention also improves the conditions for melt-down of the charge and, thus, refining of the metal. In particular, the carbon content may be controlled and, thus, selected to lower the melting point and the silicon content may also be controlled and selected to increase the melting point. Further, oxidation of the carbon promotes mixing of the melt, thereby increasing the stability and efficiency of the arcs.

Referring to Table 3 there is shown the test results (i.e., technical and economic indices) of end products employing various compositions of composite charge materials according to the invention.

The technical compositions of the charge materials investigated by Applicants are set forth in Tables 1 and 2. As illustrated in Table 2, iron-carbon alloys containing various amounts of carbon were employed as the metallic agent. The following agglomerate and iron-ore pellets were employed as the oxide agent:

| | Agglomerate | Pellets of Mikh. GOK | Pellets of Lebedinskii GOK |
|---|---|---|---|
| Fe total | 56.83 | 62.70 | 66.50 |
| FeO | 12.35 | 1.59 | 1.11 |
| $Fe_2O_3$ | 67.50 | 87.90 | 93.07 |
| $SiO_2$ | 7.20 | 7.36 | 4.60 |
| $Al_2O_3$ | 1.65 | 0.21 | 0.30 |
| CaO | 8.32 | 2.37 | 0.17 |
| MgO | 1.46 | 0.24 | 0.25 |
| MnO | 0.48 | 0.010 | 0.02 |
| $TiO_2$ | 0.13 | 0.02 | 0.035 |
| $P_2O_5$ | 0.11 | P = 0.022 | 0.011 |
| S | 0.040 | 0.01 | 0.036 |

In addition to carbon, iron carbide containing 95% $Fe_3C$, 2% $Fe_3O_4$, 2% $SiO_2$, 0.05% $Al_2O_3$, and 0.95% total CaO+MgO, and free carbon (in the form of graphite) were employed as the carbonaceous agent.

TABLE 1

| Item No. | Chemical composition of composite charge: Metallic Agent | wt. % | Oxide Agent | wt. % | Carbonaceous Agent | wt. % |
|---|---|---|---|---|---|---|
| 1-the prior art | Shavings of alloyed steel | 28 | Scale of basic alloy | 46 | Reducing agent -screenings of aluminum shavings | 26 |
| 2 | Basic pig iron | 40 | Agglomerate | 50 | Iron carbide | 10 |
| 3 | Chrome-nickel pig, brand LKhCh4 | 82.8 | Iron-ore pellets from Mikh. GOK | 17.1 | Iron carbide | 0.1 |
| 4 | Basic coke pig iron, brand PVK 1 | 70 | Iron-ore pellets from Mikh. GOK | 25 | Iron carbide 10 parts, graphite 1 part | 5 |
| 5 | Cast iron from Chusovskii Metallurgical Plant | 60 | Iron-ore pellets from Leb. GOK | 30 | Carbide $Fe_3C$, graphite | 5+ 5 |

TABLE 2

Chemical Composition of Composite Charge as a Function of Proportions of Its Components

| Item No. | Content, wt. % | | | | | | | | | | | | | | | | | | |
|---|---|---|---|---|---|---|---|---|---|---|---|---|---|---|---|---|---|---|---|
| | C | Fe met | FeO | $Fe_2O_3$ | $SiO_2$ | $Al_2O_3$ | CaO | MgO | MnO | $TiO_2$ | P | S | Si | Mn | Cr | V | Ti | Ni | Total |
| 2 | 2.38 | 46.48 | 6.24 | 33.89 | 3.90 | 0.88 | 4.3 | 0.84 | 0.25 | 0.07 | 0.07 | 0.04 | 0.26 | 0.20 | 0.1 | — | — | 0.01 | 99.97 |
| 3 | 2.99 | 74.61 | 0.27 | 15.03 | 1.26 | 0.04 | 0.41 | 0.04 | 0.002 | 0.003 | 0.004 | 0.002 | 1.27 | 0.75 | 2.03 | — | — | 0.93 | 99.8 |
| 4 | 3.6 | 69.49 | 0.43 | 22.04 | 1.93 | 0.06 | 0.61 | 0.08 | 0.003 | 0.005 | 0.01 | 0.01 | 1.06 | 0.6 | — | — | — | — | 99.95 |
| 5 | 7.93 | 60.36 | 0.36 | 28.20 | 1.39 | 0.1 | 0.08 | 0.1 | 0.006 | 0.011 | 0.05 | 0.03 | 0.35 | 0.15 | 0.33 | 0.33 | 0.13 | — | 99.86 |

TABLE 3

Technical and Economic Indices

| No. of charging stock composition | Yield of usable product | Decrease in production cost of charging stocks, % | Content of nonmetallic inclusions in metal, points | Oxygen content in metal before deoxidizing | $N_2$ content in metal, % | Assortment of metals | Remarks |
|---|---|---|---|---|---|---|---|
| Prior art-1 | 90–91.5 | 200 | No data | No data | No data | One brand: 12Kh18N10T | Production cost [for this item] was taken as 100% of production cost. |
| 2 | 92 | 100 | 4.5 | 0.22 | 0.025 | St. 10–20 | |
| 3 | 93 | 120 | 3.5 | 0.2 | 0.020 | St. 10–20 and low-alloy steel | |
| 4 | 98 | 110 | 3.0 | 0.13 | 0.018 | St. 10–20 | |
| 5 | 93 | 115 | 2.5 | 0.10 | 0.15 | St. 10–20 and low-alloy steel | |

It was found that when the content of metallic agent in the charge is less than 40%, and the content of oxide agent and carbonaceous agent are more than 50% and 10%, respectively, the yield (percentage extraction) of metal is reduced by virtue of the ejections and entrainment of solid particles due to the turbulent oxidation process of the carbon. If the content of the metallic agent in the charge is more than 82.8% and the content of oxide agent and carbonaceous agent is less than 17.1% and 0.1%, respectively, there is an increased amount of carbon in the alloy and impurities of nonferrous metals.

As illustrated in Table 3, excellent results with respect to all key indices were obtained with the following charge composition: metallic agent 40–82.8 wt. %, oxide agent 17.1–50 wt. %, and carbonaceous agent 0.1–10 wt. %.

The best results were obtained by using a charge with the following composition: metallic agent 70 wt. %, oxide agent 25 wt. %, and carbonaceous agent 5 wt. %. This composition is optimal with respect to all key engineering and economic parameters.

While preferred embodiments and their technical advantages have been described in the above detailed description, the present invention is not limited thereto but only by the core and spirit of the appended claims.

What is claimed is:

1. A composite charge for metallurgical processing, comprising:

40–83 wt. % of a metallic agent comprising an iron-carbon alloy;

17–50 wt. % of an oxide agent; and 0.1–10 wt. % of a carbonaceous agent comprising a mixture of metal carbides and free carbon.

2. The composite charge of claim 1, wherein said composite charge comprises 40–82.8 wt. % of said metallic agent.

3. The composite charge of claim 1, wherein said composite charge comprises 17.1–50 wt. % of said oxide agent.

4. The composite charge of claim 1, wherein said metallic agent includes a carbide forming component.

5. The composite charge of claim 4, wherein said carbide forming component comprises a material selected from the group consisting of iron, chromium, manganese, boron, calcium, vanadium, tungsten and mixtures thereof.

6. The composite charge of claim 1, wherein said carbonaceous agent comprises a mixture of metal carbides and free carbon, the ratio of metal carbides to free carbon being in the range of 0.1–10.0:1.

7. The composite charge of claim 6, wherein said free carbon comprises graphite.

8. The composite charge of claim 1, wherein said oxide agent comprises 5–50 wt. % of a slag forming component.

9. The composite charge of claim 1, wherein said oxide agent comprises iron ore, slag, flue dust, sludge from metallurgical processes, and mixtures thereof.

10. The composite charge of claim 1, wherein said metallic agent comprises pig iron.

11. The composite charge of claim 1, wherein said composite charge is prepared by addition of the metallic agent in molten form to the oxide agent and the carbonaceous agent.

12. The composite charge of claim 6, wherein said composite charge is prepared by addition of the metallic agent in molten form to the oxide agent and the carbonaceous agent.

13. The composite charge of claim 8, wherein said composite charge is prepared by addition of the metallic agent in molten form to the oxide agent and the carbonaceous agent.

* * * * *

UNITED STATES PATENT AND TRADEMARK OFFICE

CERTIFICATE OF CORRECTION

PATENT NO. : 5,725,681

DATED : March 10, 1998

INVENTOR(S) : Hirotake Ishitobi, et al

It is certified that error appears in the above-indentified patent and that said Letters Patent is hereby corrected as shown below:

In column 4, at line 36, please change "professes" to --processes--; and

In column 15, at table 4, test no. 37, at subheading "(T)", please change "1.86g" to --1.869--.

Signed and Sealed this

Fifteenth Day of December, 1998

Bruce Lehman

*Attest:*

BRUCE LEHMAN

*Attesting Officer*

*Commissioner of Patents and Trademarks*